US007750763B2

(12) United States Patent
Praβmayer et al.

(10) Patent No.: US 7,750,763 B2
(45) Date of Patent: Jul. 6, 2010

(54) WAVEGUIDE BEND HAVING A SQUARE SHAPE CROSS-SECTION

(75) Inventors: Peter Praβmayer, Groβkarolinenfeld (DE); Werner Blaier, Kolbermoor (DE); Krzysztof Kaczmarski, Rosenheim (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 11/878,040

(22) Filed: Jul. 20, 2007

(65) Prior Publication Data

US 2008/0018420 A1 Jan. 24, 2008

(30) Foreign Application Priority Data

Jul. 20, 2006 (DE) ..... 10 2006 033 703

(51) Int. Cl.
*H01P 1/02* (2006.01)

(52) U.S. Cl. ..... 333/249

(58) Field of Classification Search ..... 333/249
See application file for complete search history.

(56) References Cited

U.S. PATENT DOCUMENTS

| | | | | |
|---|---|---|---|---|
| 2,411,338 | A | 11/1946 | Roberts | |
| 3,672,202 | A | 6/1972 | Barber | |
| 4,795,993 | A * | 1/1989 | Park et al. | 333/249 |
| 6,253,444 | B1 | 7/2001 | Le Neve | |

FOREIGN PATENT DOCUMENTS

| | | | |
|---|---|---|---|
| EP | 0012978 | A1 | 7/1980 |
| EP | 0 285 295 | | 10/1988 |
| EP | 0 349 842 | | 1/1990 |
| EP | 0 959 515 | | 11/1999 |
| JP | 03 167901 | A | 7/1991 |

OTHER PUBLICATIONS

Erich Pehl, "Mikrowellentechnik, Band 1, Wellenleitungen und Leitungsbausteine", Dr Alfred Hütig Verlag Heidelberg, 1988, pp. 172 to 175.

Walter Jansen, "Hohlleiter and Streifenleiter", Dr Alfred Hütig Verlag Heidelberg, 1977, pp. 101 to 104.

European Office Action dated Feb. 18, 2010 (4 pages).

Doan, et al., "Oversized Rectangular Waveguides with Mode-Free Bends and Twists for Broadband Applications," 176 Microwave Journal, No. 3, Horizon House Publications, Norwood, MA, pp. 153-160 (Mar. 1989).

European Search Report issued in corresponding EPO application, Issued Oct. 18, 2007.

* cited by examiner

*Primary Examiner*—Benny Lee
(74) *Attorney, Agent, or Firm*—Nixon & Vanderhye P.C.

(57) ABSTRACT

An improved 90° waveguide bend has the following features:

the waveguide bend has two waveguide connectors located perpendicularly to each other, the waveguide connectors have a square internal cross section having an edge length (a), between the two waveguide connectors there is provided an angular portion producing the 90° change in direction, the angular portion has externally to the 90° change in direction a chamfer as a delimiting wall for the waveguide bend, the waveguide channel being outwardly delimited by the chamfer, and the chamfer has in the plane of curvature a length corresponding to the edge length (a) of the waveguide connectors which are square in cross section, ±less than 0.5%.

19 Claims, 2 Drawing Sheets

WAVEGUIDE BEND HAVING A SQUARE SHAPE CROSS-SECTION

FIELD

The technology herein relates to a waveguide bend.

BACKGROUND AND SUMMARY

Waveguides, which are known to be used in microwave technology, have various lengths, cross-sectional shapes and sizes. Hollow waveguides often have rectangular cross sections. However, round cross-sectional shapes are also known. Conventionally, waveguides of this type are equipped at the start and at the end with a flange so to join rigidly together successive waveguide portions. In a waveguide path, the cross section is usually maintained. However, transitions from one cross-sectional shape to another cross-sectional shape are also known.

It is often necessary to provide a change in a direction in a waveguide path. What are known as waveguide bends or waveguide angles are used for this purpose. Usually, these are 90° bends which change the direction of the lines of electric flux (E bends, E angles), i.e. in the case of rectangular waveguides via the broad side, or the direction of the lines of magnetic flux (H bends, H angles), i.e. in the case of rectangular waveguides in the direction of the narrow side.

Waveguide bends of this type are basically known from the publication by Erich Pehl, "Mikrowellentechnik, Band 1, Wellenleitungen und Leitungsbausteine", Dr Alfred Hütig Verlag Heidelberg, 1988, pages 172 to 175 and, for example, from Walter Jansen, "Hohlleiter und Streifenleiter", Dr Alfred Hütig Verlag Heidelberg, 1977, pages 101 to 104. The above-mentioned prior publication by Walter Jansen reproduces in this regard with reference to FIG. 6.1 b is known as an H bend and with reference to drawing 6.1 c is known as an E bend.

A 90° waveguide bend has also become known from EP 0 285 295 A1, in which the waveguide bend has an edge length is specified as 0.900 inch. For optimizing the waveguide bend while reducing absorbability, it is specified that the length L from the start of the chamfer up to the 90° corner point should, for optimizing the E plane waves, be 0.700 inch and, for optimizing the H plane wave, be 0.642 inch for an edge length of the waveguide cross section of 0.900 inch.

Exemplary illustrative non-limiting implementations herein provide a waveguide which has a square cross section and a 90° waveguide bend, i.e. a 90° waveguide angle, which can be manufactured by casting in which cost-effective and reliable adaptation to existing LNBs are possible, with electrical properties again improved over the prior art with regard to the propagation of the electromagnetic waves (i.e. both the E and the H plane waves) in the waveguide.

An exemplary illustrative non-limiting implementation provides a 90° waveguide bend which, due to its square waveguide cross section, can be used either as an E bend for lines of electric flux or as an H bend for lines of magnetic flux.

In an exemplary illustrative square waveguide, two modes, which are orthogonal to each other, are capable of propagation. In the case of a 90° bend of this type having a square cross section, reflections and transit absorptions can occur which in turn can yield insufficient electrical values for practical use.

To overcome these undesirable characteristics, it is conventional to guide both modes positioned perpendicularly to each other separately via their own rectangular waveguides or both modes jointly via a round waveguide. A round waveguide has in this case a drawback of requiring relatively large bend radii, i.e. a space-saving 90° bend cannot be carried out.

An exemplary illustrative non-limiting 90° waveguide bend is particularly suited to a frequency range of 10.7 to 12.75 GHz in both vertical and horizontal polarizations (parallel orientation to both the axes positioned perpendicularly to one another of the quadratic cross section of the waveguide).

The exemplary illustrative waveguide bend can also be applied to other frequency ranges of comparable relative bandwidth (about +/−10% based on the center frequency). A factor to consider is the edge length of the waveguide, which is then to be scaled accordingly. For the specified frequency range, the edge length is, for example, 15 mm.

Exemplary illustrative non-limiting implementations provide a 90° waveguide bend which has good electrical transmission properties, including cross-polarization decoupling, for both polarizations.

For implementing 90° waveguides of this type, it has already been proposed to configure the transition as a continuous curved portion (i.e. in side elevation as a partially circular rectangular tube).

However, conventional practice is for the two waveguide portions being configured perpendicularly to each other to be connected in the 90° bend region in such a way that the connecting side external to the internal 90° corner point has an edge length of $a\sqrt{2}$, "a" being the edge length of the square waveguide. The length of the bending therefore corresponds to a diagonal in a square having the edge length "a".

Exemplary illustrative non-limiting implementations propose a differing geometry in which the chamfer of the compensated corner in the 90° bend region corresponds to the edge length a of a square waveguide, wherein slight deviations of less than 0.1% can still be regarded as being sufficient.

Preferably, the above-mentioned dimension rule is applied to the internal dimension of the waveguide and not the external lengths in view of the wall thicknesses. The square waveguide has in this case on its connectors as its clear internal dimension the edge length "a". The chamfered wall in the angular range preferably also has as its internal dimension a length in the direction of propagation of the electromagnetic waves corresponding to the dimension a of the clear distance at the connectors which are square in cross section.

Exemplary illustrative non-limiting implementations relate to a 90° bend, but this bend does not necessarily have to be precisely 90°. It may, in principle, also be a bend designed for an angular range between 70° and 110°, more preferably for an angular range between 80° and 100° or, even more preferable still, for an angular range between 85° and 95°.

Although a 90° waveguide bend has in principle also become known from U.S. Pat. No. 6,253,444 B1, this waveguide bend has, in contrast to the subject-matter herein, a rectangular cross section rather than a square cross section. In addition, this prior publication has shown it to be fundamental that the waveguide bend does not have in the region of transition a chamfer comparable to the technology herein; instead, stepped shoulders are incorporated into the waveguide material. These may be in the form of a few large steps or a large number of steps, the height of which decreases as the number of steps increases. Nevertheless, the technology herein has revealed that an embodiment of this type does not lead to the desired properties such as may be achieved within exemplary illustrative non-limiting implementations herein.

BRIEF DESCRIPTION OF THE DRAWINGS

These and other features and advantages will be better and more completely understood by referring to the following detailed description of exemplary non-limiting illustrative embodiments in conjunction with the drawings of which.

DETAILED DESCRIPTION OP THE INVENTION

Figure 1:
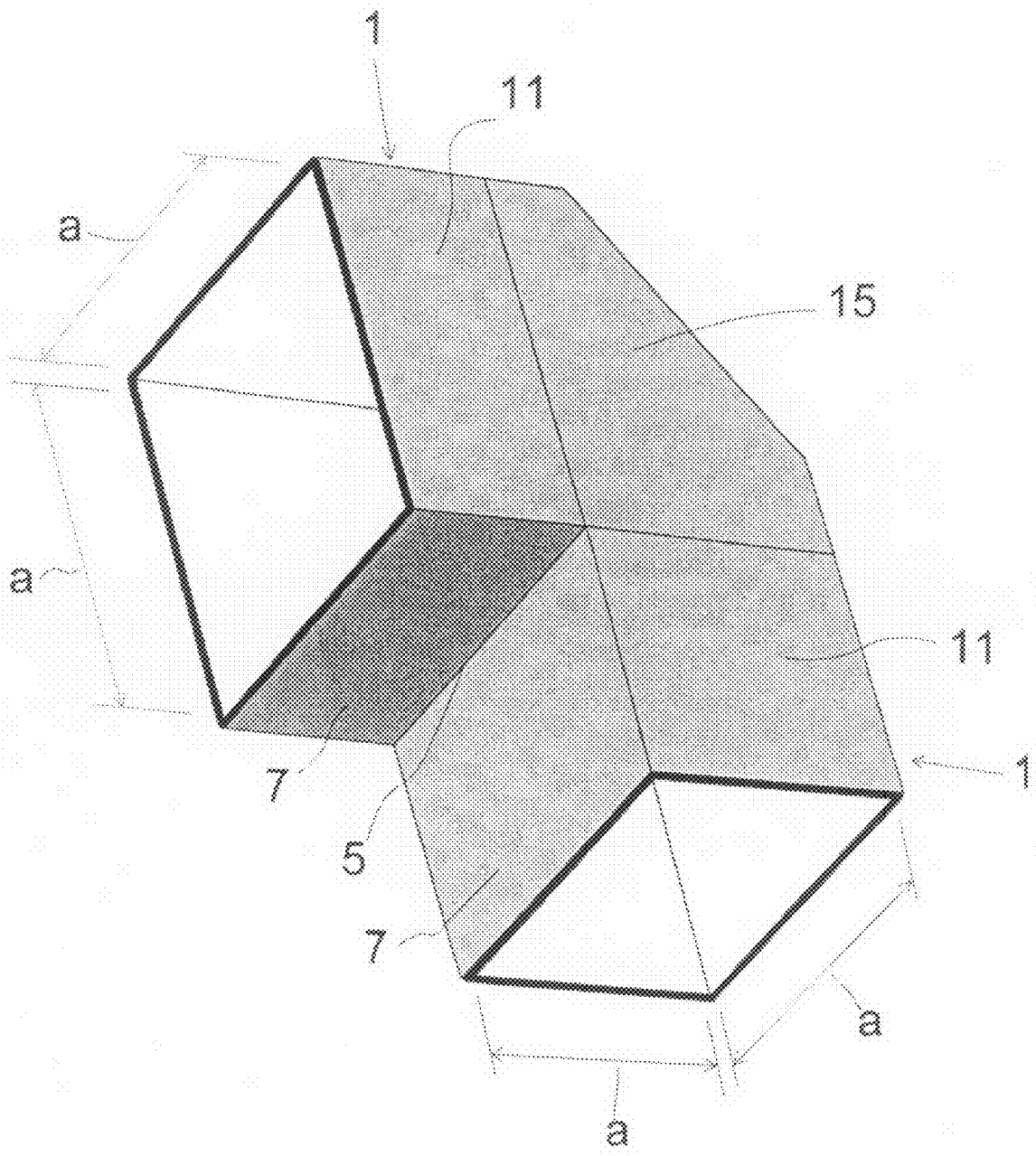
FIG. 1 is a schematic spatial illustration of an exemplary illustrative non-limiting 90° waveguide bend.

FIG. 1 is a schematic 3D illustration of an exemplary illustrative non-limiting embodiment of a 90° waveguide bend comprising two straight waveguide connectors 1 located perpendicularly to each other.

These waveguide connectors 1 have a square cross section having an edge length "a".

The housing wall is made of electrically conductive material such as metal. This material is preferably a cast material, as the exemplary waveguide may be manufactured by casting. The cast or die-cast materials used are preferably zinc, brass and/or aluminum. Other materials or combinations and alloys of materials are also conceivable. The exemplary waveguide angle does not necessarily have to be manufactured by casting. Other manufacturing processes and methods are also possible.

The waveguide material may also be of a non-conductive, dielectric material if it is coated with an electrically conductive layer. While not shown, waveguide connectors 1 also can have, on their connection side which is open at the end face, a further circumferential flange to which the waveguide bend thus formed can also be connected using a subsequent, generally straight waveguide connector or, for example, a waveguide connection of an LNB or other modification parts.

If the ends of a waveguide bend are conventionally equipped with flanges, these may, in particular, be what are known as screwing flanges such as are conventional in rectangular waveguides. Equally, it is possible to connect the described waveguide bend, for example, to an LNB using a sleeve connection. In other words, the waveguide bend slips onto or over the waveguide connection of the LNB. The other end of the waveguide bend can be equipped so as to ensure a corresponding connection depending on the subsequent component.

As may be seen from the 3D illustration according to FIG. 1, the exemplary 90° waveguide bend or waveguide angle has an internal edge 5 at which inner wall portions 7 of the two waveguide connectors 1 approach each other at a 90° angle. In other words, the inner wall portion 7, shown on the left-hand side in FIG. 1, and an outer wall portion 9, which also forms part of the left-hand waveguide connector 1, are parallel to each other. The inner and outer wall portions 7, 9 of the waveguide connector 1 shown on the right-hand side in FIG. 1 are also oriented parallel to each other. The inner and outer wall portions 7, 9 of the waveguide connector 1 located on the left-hand side are then oriented perpendicularly to the inner and outer wall portions 7, 9 of the waveguide connector 1 located on the right-hand side in FIG. 1. Lengths of the inner and outer wall portions in the direction of propagation of the electromagnetic waves are not crucial. The lengths thereof can be preselected as desired.

Figure 2:
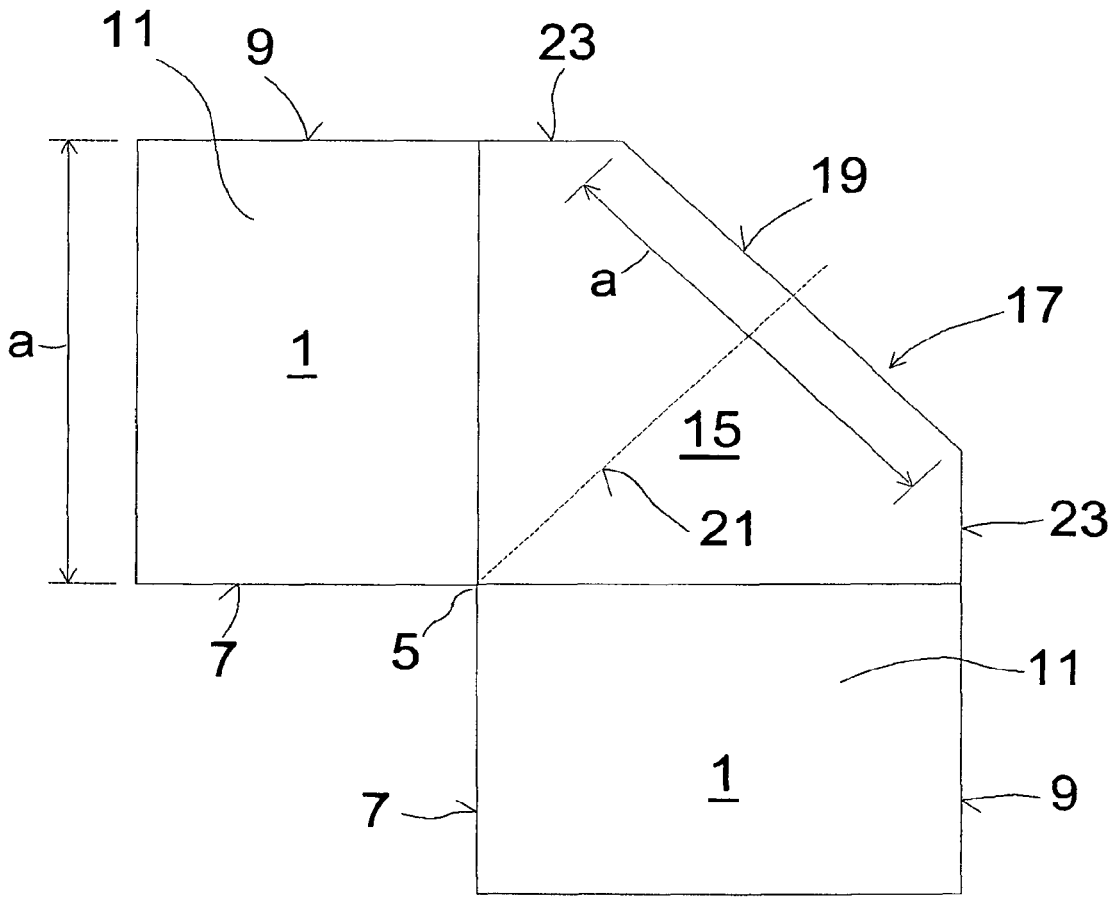
FIG. 2 is a schematic side elevation of the exemplary non-limiting embodiment according to FIG. 1.

Further, upper and lower wall portions 11, each offset by 90° to the aforementioned wall portions 7 and 9, of the two waveguide connectors 1 are each located in a common plane, i.e. in an upper plane shown in FIG. 1 and a lower plane which is parallel thereto and in which a bend delimiting wall 15 of an angular portion 17, illustrated in FIG. 2, itself comes to rest. Both in the upper plane and in the lower plane as shown in FIG. 1, the bend delimiting wall 15 is a transition wall portion respectively between the wall portions 11 of the two waveguide connectors 1. Moreover, the upper plane as shown in FIG. 1, formed from the wall portion 11, the adjoining bend delimiting wall 15 and the subsequent wall portion 11 of the subsequent waveguide connector 1, (and also all planes parallel thereto) forms what is known as the plane of curvature in which the 90° curvature and the direction of propagation of the waveguide are defined.

As may be seen, in particular, from the plan view according to FIG. 2, there is provided externally to the internal 90° edge, which extends in the plan view according to FIG. 2 perpendicularly to the plane of the drawings, a chamfer 19 as the delimiting wall extending perpendicularly and symmetrically to the bisecting line 21 of the 90° bend. In FIG. 2, the internal 90° edge is formed by the internal wall portions 7 of the two connectors 1 intersecting at the internal edge 5. FIG. 2 also illustrates the outer wall portions 9, the upper and lower wall portions 11, the delimiting wall 15, and the angular portion 17.

This arrangement therefore produces compensating wall portions 23 which each come to rest, in the extension of the outer wall portion 9 of the two waveguide connectors 1, in the same plane as the connectors.

The chamfer 19 has in the plan view according to FIG. 2, a length corresponding to the edge length "a" of the waveguide connectors 1 which are square in cross section. A dimensioning of this type provides very desirable conditions for the propagation of an electromagnetic wave in this waveguide angular part. Deviations from the edge length a for the chamfer 19 in the direction of propagation of the electromagnetic waves of less than 0.5% are still sufficient to achieve the desired success.

The length of the wall referred to as the chamfer 19 preferably extends at a 135° angle to the orientation of the waveguide connectors 1 (i.e. in the direction of propagation of the electromagnetic waves running through the waveguide bend) corresponds to the edge length "a", i.e. has the same length as the edge length of the opening regions of the waveguide connectors 1. This length of the chamfer 19 is therefore measured in the direction of the plane of curvature. As the height in the direction perpendicular thereto in the waveguide bend also has the edge length "a", the wall defined by the chamfer 19 therefore has a square shape, as not only the length but also the height located perpendicularly thereto corresponds to the edge length "a".

Exemplary illustrative non-limiting implementations have been described with reference to a 90° waveguide bend. However, the waveguide bend can also have other values and is not necessarily restricted to 90°. In principle, the waveguide bend could have a curvature of between 80° and 100° or less, for example between 85° and 95° or between 87° and 93°, especially between 89° and 91°. To this extent, the term "90° waveguide bend", as used herein, includes a bend having one of the above-mentioned angular ranges.

It should also be noted that the above-specified dimensions with respect to the edge length having the dimension "a" but also with respect to the length of the chamfer having the length "a" refer in each case to the internal dimension of the waveguide portions. The waveguide angular part may have a wall having any desired thickness and any desired wall thickness, so the external dimensions on the edge length or the external dimension on the chamfer may differ from the length "a". The waveguide internal dimensions with respect to the square opening has with respect to the waveguide channel in the longitudinal and transverse directions of the square waveguide the edge lengths "a", the dimension, internal to the waveguide inner part, of the chamfer having the length "a" and a height having the clear internal dimension "a".

The external contours may therefore also be angular in the region of what is known as the chamfer. In other words, the compensating wall portions 23 shown in the figures may be extended and end abutting each other at right angles, so as to form an outer vertical edge, with the chamfer 19 being provided internally as a delimiting wall of the waveguide channel. As stated before, merely the dimension and the configuration of the waveguide angular part are described with respect to the inner walls delimiting the waveguide channel. In other words, all of the above-described walls are the inner walls and/or surfaces outwardly delimiting the waveguide channel.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

The invention claimed is:

1. A 90° waveguide bend, comprising:

two waveguide connectors located perpendicularly to each other, wherein the waveguide connectors each has a square internal cross section having an edge length (a), wherein between the two waveguide connectors, there is provided an angular portion producing a 90° change in direction, wherein the angular portion has externally to the 90° change in direction a chamfer as a delimiting wall for the waveguide bend, a waveguide channel being outwardly delimited by the chamfer, wherein the chamfer has in a plane of curvature a length corresponding to the edge length (a) of the waveguide connectors which are square in cross section, ±less than 0.5%, and wherein the chamfer merges with two external compensating wall portions each located in an extension corresponding to respective outer wall portions of the two wave guide connectors.

2. The 90° waveguide bend as claimed in claim 1, wherein the delimiting wall, defined by the chamfer, of the waveguide bend is square shape.

3. The 90° waveguide bend as claimed in claim 1, wherein the chamfer is oriented perpendicularly to a bisecting line of the 90° waveguide bend.

4. The 90° waveguide bend as claimed in claim 1, wherein the chamfer is oriented perpendicularly to a bisecting line that extends to an internal edge at which, internally to the 90° bend, inner wall portions of the two waveguide connectors abut each other.

5. The 90° waveguide bend as claimed in claim 1, wherein a reflecting surface of the chamfer is flat.

6. The 90° waveguide bend as claimed in claim 1, wherein the length of inner and outer wall portions is preselectable in the direction of propagation of the electromagnetic waves on the connectors.

7. The 90° waveguide bend as claimed in claim 1, wherein the waveguide bend is configured so as to allow a propagation of an electromagnetic wave in an angular range of from 80° to 100°.

8. The 90° waveguide bend as claimed in claim 1, wherein the waveguide bend is configured as a metal cast part.

9. The 90° waveguide bend as claimed in claim 1, wherein the waveguide bend is configured so as to allow a propagation of an electromagnetic wave in an angular range of from 85° to 95°.

10. A 90° waveguide, comprising:

two waveguide connectors located perpendicularly to each other, wherein the waveguide connectors each has a square internal cross section having an edge length (a), wherein between the two waveguide connectors there is provided an angular portion producing a 90° change in direction, wherein, the angular portion has externally to the 90° change in direction a chamfer as a delimiting wall for the waveguide bend, a waveguide channel outwardly delimited by time chamfer, wherein the chamfer has in a plane of curvature a length corresponding to the edge length the waveguide connectors which are square in cross section, ±less than 0.5% and wherein the edge length (a) of the chamfer is the same for both E and H flux modes.

11. The 90° waveguide bend as claimed in claim 10, wherein a reflecting surface of the chamfer is flat.

12. The 90° waveguide bend as claimed in claim 10, wherein the delimiting wall, defined by the chamfer, of the waveguide bend is square shape.

13. The 90° waveguide bend as claimed in claim 10, wherein the chamfer is oriented perpendicularly to a bisecting line of the 90° waveguide bend.

14. The 90° waveguide bend as claimed in claim 10, wherein the chamfer is oriented perpendicularly to a bisecting line that extends to an internal edge at which, internally to the 90° bend, inner wall portions of the two waveguide connectors abut each other.

15. The 90° waveguide bend as claimed in claim 10, wherein the chamfer merges with two external compensating wall portions each located in an extension corresponding to respective outer wall portions of the two waveguide connectors.

16. The 90° waveguide bend as claimed in claim 10, wherein the length of inner and outer wall portions is preselectable in the direction of propagation of the electromagnetic waves on the connectors.

17. The 90° waveguide bend as claimed in claim 10, wherein the waveguide bend is configured so as to allow a propagation of an electromagnetic wave in an angular range of from 80° to 100°.

18. The 90° waveguide bend as claimed in claim 10, wherein the waveguide bend is configured as a metal cast part.

19. The 90° waveguide bend as claimed in claim 10, wherein the waveguide bend is configured so as to allow a propagation of an electromagnetic wave in an angular range of from 85° to 95°.

* * * * *